United States Patent [19]

Rivière

[11] 4,301,758

[45] Nov. 24, 1981

[54] CRAFT WITH AT LEAST TWO HULLS

[75] Inventor: Charles E. F. Rivière, Neuilly-sur-Seine, France

[73] Assignee: Comex Industries, Marseilles, France

[21] Appl. No.: 35,540

[22] Filed: May 3, 1979

Related U.S. Application Data

[63] Continuation-in-part of Ser. No. 935,864, Aug. 22, 1978, abandoned, which is a continuation of Ser. No. 770,318, Feb. 18, 1977, abandoned, which is a continuation-in-part of Ser. No. 565,609, Apr. 7, 1975, abandoned.

[30] Foreign Application Priority Data

Apr. 11, 1974 [FR] France ..... 74 12711

[51] Int. Cl.[3] ..... B63B 1/10

[52] U.S. Cl. ..... 114/61

[58] Field of Search ..... 9/6 R, 6 M, 6 P, 6 W; 114/56, 61, 39, 290, 292

[56] References Cited

U.S. PATENT DOCUMENTS

| | | | |
|---|---|---|---|
| 1,712,758 | 5/1929 | Durand | 114/290 |
| 4,002,133 | 1/1977 | Wilbanks | 114/39 |
| 4,008,674 | 2/1977 | Nitzki et al. | 114/61 |

FOREIGN PATENT DOCUMENTS

| | | | |
|---|---|---|---|
| 978769 | 4/1951 | France | 114/61 |

*Primary Examiner*—Trygve M. Blix
*Assistant Examiner*—Jesús D. Sotelo
*Attorney, Agent, or Firm*—Haseltine and Lake

[57] ABSTRACT

A craft or boat of the type comprising two hulls and joined by a bridge deck is disclosed. Highly efficient hull design is defined by specific relationships along the waterline length, maximum bulge of each hull, the distance between the hulls at the location of the bulge, the distance from the bow to the location of minimum distance between the hulls and the immersed depth of each hull. Non-symmetrical hulls, about their respective longitudinal axis, are also disclosed.

3 Claims, 4 Drawing Figures

CRAFT WITH AT LEAST TWO HULLS

CROSS-REFERENCE TO PRIOR APPLICATION

Figure 1:
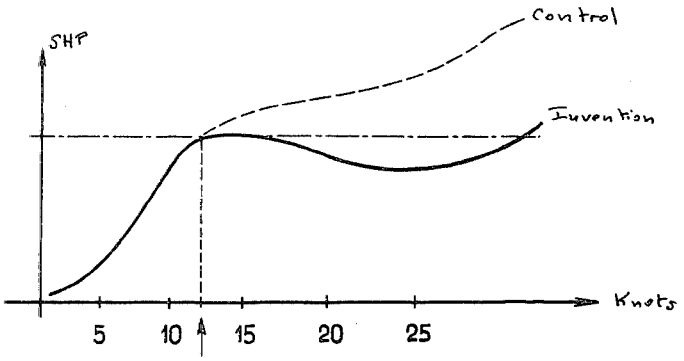

This is a continuation-in-part of Ser. No. 935,864 filed Aug. 22, 1978 and that application was a continuation of Ser. No. 770,318 filed Feb. 18, 1977 which was a continuation-in-part of Ser. No. 565,609 filed Apr. 7, 1975, all now abandoned.

This invention relates to ships generally known under the generic denomination of "Catamarans" having two lateral displacement hulls, joined together by a bridge-deck acting as an extra central hull above the water, such as those described in the French Pat. No. 978 769 (Cluzel).

This invention relates to the general means, shape characteristics, positioning and dimensional ratios relating to the measurements of the immersed parts of the hull or wetted areas of the ship, which when applied to certain types of these ships, preferably power driven types, create, between the hulls, when a certain speed is reached, a natural phenomenon, that is to say, a stationary wave with a fixed wave length in opposite phase to the outer waves of the hulls.

This stationary wave, thanks to the particular shapes of these ships, permits them to recover an important part of the energy lost by the inner bow waves, and at speeds approaching the critical speed, or over it, to create particular performances of high speed, low fuel consumption, comfort, sea worthiness, making it uncapsizable.

These particular characteristics which form the subject matter of this invention relate to the whole of the immersed parts of the hull made of the inner parts of the lateral hulls, and the linking bridge-deck, the under surface of which having itself a particular shape—to act as a third hull—.

This under surface provides an extra buoyancy which comes into action when the speed approaches the critical speed and above it.

In displacement craft of the "Catamaran" type with two hulls, the two bows, as it is well known, create four waves instead of two in the case of classical monohulls.

(a) The two outer waves perform in a normal way, in accordance with the laws of Froude and Reynolds: as the speed increases the trough of these waves, located behind the first crest, reaches the stern of the ship which consequently tends to rear, resulting in an increase in the resistance to move forward; that is what is named "critical speed". This critical speed is proportional to the square root of the length of the ship at the waterline. This wave system is not stationary, its wave length increases with the speed.

(b) The two inner bow waves, between the hulls knock together and create turbulence phenomena which slow down the craft. It is those two phenomena (a) and (b) which usually limit the speed, the comfort and seaworthiness of ordinary catamaran.

(c) It should be here remembered that the shape of the hulls of all ships must comprise a bow followed by a widening reaching a bulging area (maximum beam) followed by a progressive decrease towards the stern. Now in the case of ships with two hulls, this bulge is an obstacle to the course of the waves created by the bows. This obstacle unavoidable on whatever the type of ship is a new cause of loss of energy which adds to those caused by the bows.

The invention is the result of a number of observations on original tests, according to which between the hulls of a Catamaran, in certain cases, the laws of Froude and Reynolds do not apply, while on the contrary, under certain architectural conditions, similar effects take place as those that occur in canals when an obstacle in the bottom of the canal produces a succession of undulations the wave length of which is fixed (so called stationary wave) whatever the speed of the current. However, in the case of the invention, the canal has sides but no bottom, so that nothing could allow one to foresee that a partially comparable phenomena would take place.

Moreover, as no obstacle in the bottom of the canal can exist in the case of a ship according to the invention, it is merely the combined effect of the two inner bow waves, that produce a similar effect to that of an obstacle at the bottom of a canal which, in the canal, causes a fixed stationary wave system on the water surface.

This phenomenon, as such, would not have found a field of application in naval engineering, had the effect of a canal with a boundless bottom not been amplified, and the turbulence been mastered by placing a new "obstacle" in a very precise area, that is to say a Venturi bottle-neck created by the narrowing of the canal corresponding to the two inner bulges of the hulls and if the central bridge-deck, by its shape and positioning, at the rear of the center of buoyancy of the craft, close the water level, and at a positive incline had not made it possible to make use of this hydrodynamic effect for a sustaining (uplifting) and propulsive (surfing) purpose.

The longitudinal positioning of this inner narrowing of the canal between the hulls, which in a normal catamaran would have corresponded to the maximum beam and thus would have been in keeping with the normal criterion of the laws of Froude and Reynolds concerning the wave propagation in free waters, must obey new criterions i.e. that this narrowing to obtain this unexpected favorable effect, on which the invention is based, that is to say the remarkable potential of the intensity of the undulation phenomenon caused by the bows, must be located in the area where the inner bow waves join and simultaneously in the area that precedes the first trough of the said wave when the speed reaches three quarters of the critical speed of the craft.

Now on the other hand, it has been discovered in the experimental evaluation-assessment of the parameters for the building of such a boat, that at a speed such as that neighboring the critical speed, the stationary inner wave is practically in phase opposition to the normal outer wave; thus the result, which was far from being obvious, explains why and how the longitudinal location of the Venturi bottle-neck has been defined, and why it is specified that the positioning of the inner bulges of the hulls must be established independantly from that of the outer bulges. There is in effect no reason for these areas to coincide, thus the ships according to the invention present the characteristics of both longitudinally and transversally unsymetrical hulls.

These conditions will be full-filled if the transversal distance between the bows is simultaneously comprised between 12L/45 and 19L/45 and if on the other hand the longitudinal distance from the Venturi bottle-neck to the bows is comprised between L/3 and L/2, L being the length of the craft at the waterline.

This potential, that is to say the amplifying of the stationary wave would not take place should these bulges be placed in another location, or should the space between the bows be different.

It must be noted that the connection of the bow waves in a particular area, depends also on the shape of the inner face of the bows which must be at a sharp angle in order that the bow wave diverges at an angle between 18° and 25° from the axis of the hulls.

It must also be noted that the distance between the two bows must be approximately equal to (more or less 20% than) to the distance between the inner bulges and the bows at the water line: it is in these conditions that the conjunction of the waves takes place slightly behind the Venturi bottle-neck, and that thus the maximum energy dispensed by the bows is gathered in the favorable area.

The invention therefore is generally based on the double discovery that when a ship of the catamaran type is built according to the teaching of the invention:

1—The whole body formed by the two internal half hulls forms the equivalent of a tuyere: the narrowest part of which acts as that of a Venturi bottle-neck into which the water captured by the inner bows is engulfed and the effect of a bottomless canal resulting from the conjunction of the effects of the two types of obstacles on the course of the water current produces at the level of the Venturi bottle-neck, that is to say in the narrowest part of this canal, a stationary wave which amplyfies and masters the undulation system produced by the conjunction of the two inner bow waves in that same location. This wave which is stationary relative to the flanks of the ship and which moves at the same speed as the ship, presents a depression at the bottle-neck level (first trough which is amplified by the conjunction of the inner bow waves) and a crest located at the third aft of the craft.

2—Such a crest becomes a positive stationary wave, with a periodical break moving along at the same speed as the ship, thus without any friction as regards the ship. This permanent wave thanks to the definition of the parameters regarding the shape, the position and particular measurement ratios, according to the invention, is formed aft of the center of buoyancy of the craft and thanks to the position, the shape and positive incline of the bridge-deck in this area, uplifts the stern of the craft to a "surfing" position thus affording high speeds with relatively little power and a remarkable both lateral and longitudinal stability.

The point of impact of this permanent breaking wave beneath the bridge-deck behind the center of buoyancy has the effect of displacing this center towards the stern, by creating this new buoyancy thus preventing the rearing of the boat which normally happens on all ordinary ships when approaching the critical speed (thus preventing them to go beyond this speed). It is the opposing of the classical outside wave of the boat to the phase of the stationary wave channeled in between the hulls according to the invention that stops the boat from rearing and allows for new performances over and above the critical speed.

Thus, for instance, on a 24 m long boat this Venturi effect appears at 13 knots and is effective at all the higher speeds without limitation.

It is this phenomenon that is illustrated on FIG. 1 of the attached drawings, where the curve is represented as well as the necessary power per ton displacement in regard to the speed of the craft in knot.

On such a curve, one can see that up to 27 knots the boat has had the benefit of an available surplus of power, and that beyond 27 knots, this beneficial effect of the bringing into being of the invention, continues to be felt, as, without this effect, the necessary power would have been considerably stronger (witness curve in dotted line).

It must be well noted that the invention applies only to certain boats, restrictively:

(A) Firstly, it aims only at the fast boats that are meant to travel above their critical speed and capable of easily reaching speeds above it without rearing; in other words the invention only applies to boats provided with sufficient means of power of propulsion to pass over the hump of the curve on FIG. 1, that is to say the area where drag resistance to forward progression is generated when the speed of the boat approaches the critical speed. A first restrictive condition for applying the invention therefore concerns the true propulsive power per ton of displacement, which must not be under 30 SHP/Ton (shaft-horse power) or in the case of motor sailing, the sail area must be over 10 sq. meters per ton of displacement and the power of the motor over 15 SHP/Ton (B) Furthermore, the displacement weight (weight underload) of the boats likely to benefit by making use of the invention must for a 12 m boat, be at least 10 tons and then increase in proportion to the cube of the ratios of the lengths, which then shows an immersed portion of the hulls in the shape of a tuyere at least 0.60 m deep for a 12 m boat and at least 1.20 m for a 24 m boat or a minimum depth of immersed hull equal to 1/20 of the length L. The immersed portion is productive of the stationary wave phenomenon: consequently its inner bulge must present a sufficient minimum volume.

Such a restriction therefore eliminates from the field of the invention pure racing boats and also obviously the hydroplane floats such as described for example in the U.S. Pat. No. 2,964,271 (Strawn).

Indeed, these machines, by lack of immersed volume, would also not produce the stationary wave phenomenon expected and would not, what is more, provide the necessary righting moment to ensure that the craft is uncapsizeable.

The depth of immersion of the hulls according to the invention at the level of the Venturi bottle-neck is an important factor on which depends the efficiency of the lifting and propulsing actions of the bridge-deck when it is in contact with the crest of a stationary wave. The proof of this is provided by the measure of resistance tests and fuel consumption on two identical vessels built according to the invention but with one of them loaded (54 tons displacement) and the other underlight draught (35 ton displacement).

While the consumption per ton of displacement and per mile is at speeds below the critical speed, less for the lighter boat, the consumption at a speed above the critical speed appears as less for the heavier boat.

This reversal of results, which may seem paradoxical, comes from the fact that it is the heaviest boat that creates the phenomenon which is the most important basic matter of the invention, and due to this fact the heaviest boat recovers more energy than the lighter boat which gives it an advantage at high speed, while at low speed, less than $\frac{3}{4}$ of the critical speed, as the phenomenon does not take place, it is the lighter boat which consumes less fuel.

This makes it possible, what is more, to specify once again that ships built according to the invention, are boats with said displacement hulls making use when nearing the critical speed, of the phenomenon generated by the particular designs of the lateral hulls (stationary breaking waves) to carry and propel the craft in its center by bringing into action suddenly, at a speed neighboring $\frac{3}{4}$ of the critical speed, a new buoyancy at the aft third portion of the bridge-deck, which not only supports the boat, but also pushes it forward thanks to the shape of its central planing hull, positively inclined.

It is therefore well defined that the boat which has become a planing craft to reach and go above its critical speed, does nonetheless remain a displacement craft through its two lateral hulls which steady it and by their own displacement inside the canal they dynamically maintain the production of the undulating phenomenon of the breaking wave.

It is the combination of this planing central hull, which only operates after $\frac{3}{4}$ of the critical speed has been reached and the two displacement hulls, which make up the dynamic originality of the craft according to the invention, while when at rest, its shapes do not let one suppose that these particular qualities exist.

It is necessary to insist on the fact that this is not the case either in boats of the type of the french Pat. No. 978 769 (Cluzel) mentioned above, that are always displacement hulls, or in those of the type of U.S. Pat. No. 2,964,271 (Strawn), also mentioned above that are always planing crafts, neither in fact of any type of existing boats, that are all, without exception, either displacement, or planing or semi-planing boats and are never as in the case with the present invention, both pure displacement boats at speeds below the critical speed and together displacement and planing boats at speeds above the critical speed, which confers to them exceptional sailing qualities at high speeds without loss of their normal qualities at low speeds or in heavy weather.

These restrictive conditions having been fulfilled, the invention resides in the combination of at least five fundamental dimensional characteristics defined below:

I. "L" being the length of the boat at the waterline, the maximal distance r between the interior wall of a hull and the longitudinal axis of the same hull must be comprised between 2L/45 and 4L/45.

This first characteristic has for result that the energy which is displaced inside the two hulls of the craft neighbors that which the invention recovers behind the center of buoyancy to uplift that part of the craft when it approaches the critical speed and to participate in the propulsion of the craft through sliding like a surfing board on the forward surface of this wave which moves at the same speed as the craft that created it.

II. The distance between the hulls on the maximum bulge, or width of the Venturi bottle-neck is comprised between $L/6$ and $L/4$.

III. The distance between the inner bulges of both hulls and the tine which joins the bows at the waterline level must be comprised between L/3 and L/2. Indeed, according to the invention, the longitudinal position of the inner bulges of the hulls or position of the Venturi bottle-neck does not forcibly coincide with the outer bulges.

IV. The minimum distance in normal load from beneath the central bridge-deck to the water level when at rest is comprised between $L/60$ and $L/30$ what is more, the under surface of the bridge-deck is inclined away from the water level towards aft of the center of buoyancy.

V. Lastly, the depth of the immersed hull of the boat under normal load is over and above L/20.

In practice the combination between them of these five conditions imposes at the distance that separates the bows a value established by the proceeding parameters the average value of which is L/3, the third of the length at the waterline of the craft.

Moreover, but this is optional, the boat according to the invention can advantageously present two other features that also enter into the scope of the invention:

VI. The bridge-deck must be connected to the hulls at a tangent in the shape of two vaults joined together by a central rib. The supporting wave will thus have a greater stabilizing effect, thanks to this double vault, because of the application point of the vertical sustaining thrust which in the case of such a double vault, uplifts the side which is inclined, while the same vertical thrust applied to a single vault would only have the effect of accentuating the incline. Naturally, this double vault can only act if the Venturi effect of the resulting wave has been caused to act.

VII. On the other hand, in practice, each of the two hulls presents an unsymmetry in regard to its longitudinal axis. This condition comes from I and V acting together:

on the one part the minimum displacement, so that the phenomenon of the stationary wave can take place necessarily calls for minimum buoyancy and on the other part the bulge at the level of the Venturi bottle-neck is limited in order not to mobilise in the forward part of the canal, more energy than it is possible to make use of behind the bottle-neck.

The consequence of these two conditions is the unequal distribution between the inner and outer parts of the two hulls of the volume of buoyancy corresponding to the displacement of each hull.

The most beneficial distribution would be to affect the most important bulge on the outer face of each hull rather then on the inner face.

What is more, a second cause of unsymmetry of the hulls is the fact of the longitudinal positioning of the outer bulges which are generally located further back than the inner bulges.

Thanks to this set of building conditions and to the position of the parts of the craft according to the Inventor this ship is able:

to recover part of the lost energy by the shaping of the inner wave to direct the turbulent undulation phenomena thus reducing the wetted area to prevent the rearing which takes place at the approach of the critical speed to limit heeling or the incline of the ship in relation to the surface of the water to absorb progressively the rolling of the ship, thus providing not only comfort for the passengers but security in heavy beam seas to provide on the seeside alias on the side of the incline of the ship a permanent fulcrum which allows for the weight of the boat itself to exert, thanks to this fixed point, a lever producing a righting moment which limits the list at practically a maximum of 4° to 10°. Thus the craft becomes uncapsizable in all conditions of sea or wind, as long as the weight (or displacement) of the craft is at least equal to the minimum already specified (10 tons for a boat 12 m long at the waterline).

Figure 2:
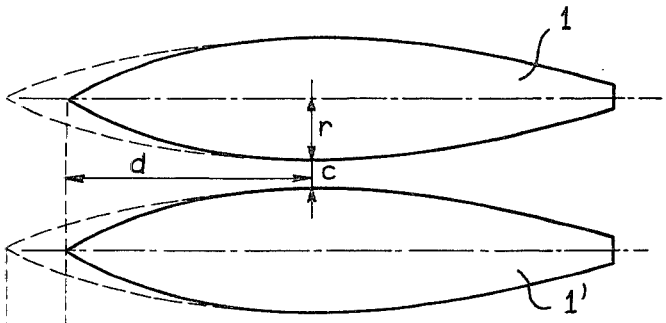
Figure 3:
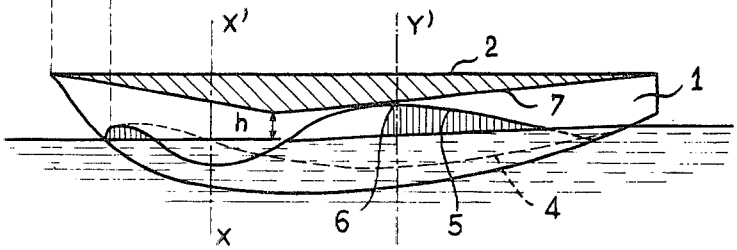
Figure 4:
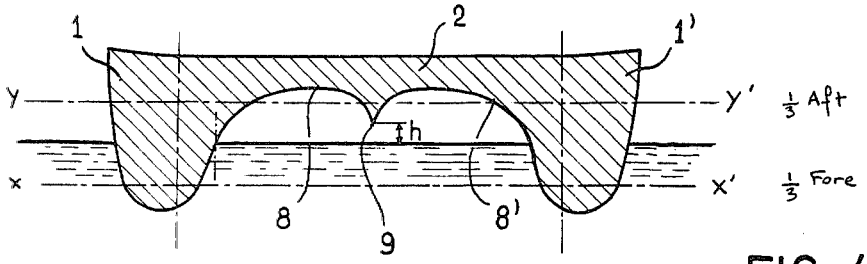

We will now describe the invention with reference to the enclosed drawing on which:

FIG. 1 shows the curves of the necessary power per ton of displacement in function of the speed in knots of the craft as shown below FIG. 2 is a horizontal section of a ship, according to the invention, at the waterline level FIG. 3 is a vertical section of the same ship at the longitudinal axis of the bridge-deck FIG. 4 is a vertical transversal section showing the position of the internal waves in various positions along the ship.

If we refer first to FIG. 1, we can see that this figure gives us a schematic view of the varying power needed per displaced ton according to the speed of the ship. Up to close to the critical speed, around 12 knots the curve remains the same whatever the type of craft. On the other hand, while, for an ordinary boat, the power continues to increase with the speed (see witness curve), for a ship according to the invention, the power lessens as the speed increases, in such a manner that the power needed at about 27 knots is about of the same order as that for the critical speed.

If now we refer to FIGS. 2, 3 and 4, the ship according to the invention has been represented very schematically comprising two hulls 1 and 1' joined together by a central platform or bridge-deck 2. On these drawings have been placed the various measurements that come into the creation of the phenomenon on which the invention is based:

Length at the water line L, the maximum internal bulge of the hulls r, the distance c between the two hulls at this maximum internal bulge that is to say the width of the Venturi bottle-neck, the distance d from this Venturi bottle-neck to the line of the bows and the distance h from the underside of the lowest point of the bridge-deck to the level of a calm sea.

On FIG. 3 have been shown the outer waves 4 and the shape of the stationary wave 5. One notices that those two waves show an opposition of phase, the internal wave 5 forming a stationary crest 6 exerting an uplifting and propulsing effect aft of the bridge-deck 7; what is more, this aft section is inclined from the center of buoyancy to the stern at an angle that separates it from the sea level.

At last, it is seen on FIG. 4 the double vault 8—8' beneath the bridge-deck with the central rib 9. On this FIG. 4 has been shown the level of the inner stationary wave in the third forward area X—X' and the third aft area Y—Y' in order also to picture the manner in which the stationary wave creates an extra buoyancy under the aft section of the bridge-deck.

What I claim is:

1. A ship having two lateral displacement hulls and a non-immersed central platform joining the two lateral hulls, which comprises in combination of defined shapes and dimensional ratios taken together, L being the length of the ship at the water line:

$$2L/45 < r < 4L/45 \qquad \text{I.}$$

where r is the maximum interior bulge of one hull;

$$L/6 < c < L/4 \qquad \text{II.}$$

where c is the distance between the hulls at the maximum bulge, or the width of the Venturi bottle-neck;

$$L/3 < d < L/2 \qquad \text{III.}$$

where d is the distance from the bow to the Venturi bottle-neck;

$$L/20 < i \qquad \text{IV.}$$

where i is the immersed depth of the hull under normal load or draught; and wherein the non-immersed central platform comprises a centered, longitudinal rib and wherein the minimum distance h, under normal load, of the lowest point of the central rib to the surface of a calm sea is defined between the following limits:

$$L/60 < h < L/30$$

and the underside of the said platform is inclined away from the water surface aft of the center of buoyancy.

2. A ship according to claim 1 wherein the underside of the central platform has the shape of a double vault, each said vault being on either side of the unimmersed central rib.

3. A ship of a type comprising two lateral displacement hulls and a non-immersed central platform joining the two lateral hulls, characterized by the combination of shapes and dimensional ratios defined hereunder that must be taken together, L being the length of the ship at the water line:

$$2L/45 < r < 4L/45 \qquad \text{(I)}$$

where r is the maximum interior bulge of one hull $$L/6 < c < L/4 \qquad \text{(II)}$$

where c is the distance between the hulls at the maximum bulge, or the width of the Venturi bottle-neck $$L/3 < d < L/2 \qquad \text{(III)}$$

where d is the distance from the bow to the Venturi bottle-neck $$L/20 < i \qquad \text{(IV)}$$

where i is the immersed depth of the hull under normal load or draught, and by the fact that each hull possesses a longitudinal axis and further comprises an inner and an outer bulge situated on either side of the said longitudinal axis; that each hull presents an unsymmetry with respect to the said longitudinal axis; and that the said outer bulges are located further back than the inner bulges.

* * * * *